US005252937A

United States Patent [19]

Bernier et al.

[11] Patent Number: 5,252,937

[45] Date of Patent: Oct. 12, 1993

[54] MOLDED CASE CIRCUIT BREAKER MODULAR BELL ALARM UNIT

[75] Inventors: Richard E. Bernier, Southington; Joseph G. Nagy, Plainville; Ira B. Goldman, Waterbury, all of Conn.

[73] Assignee: General Electric Company, New York, N.Y.

[21] Appl. No.: 564,901

[22] Filed: Aug. 9, 1990

[51] Int. Cl.[5] ..... H01H 9/02

[52] U.S. Cl. ..... 335/202; 361/781; 361/837

[58] Field of Search ..... 361/400, 405, 406, 398, 361/399; 335/202

[56] References Cited

U.S. PATENT DOCUMENTS

| | | | |
|---|---|---|---|
| 4,297,663 | 10/1981 | Seymour et al. | 335/20 |
| 4,589,052 | 5/1986 | Dougherty | 361/94 |
| 4,622,444 | 11/1986 | Kandatsu et al. | 200/303 |
| 4,661,792 | 4/1987 | Watkins | 361/405 |
| 4,679,019 | 7/1987 | Todaro et al. | 335/172 |
| 4,700,161 | 10/1987 | Todaro et al. | 335/172 |
| 4,728,914 | 3/1988 | Morris et al. | 335/6 |
| 4,737,903 | 4/1988 | Nishikawa et al. | 361/400 |
| 4,786,885 | 11/1988 | Morris et al. | 335/202 |
| 4,788,621 | 11/1988 | Russell et al. | 361/115 |
| 4,794,356 | 12/1988 | Yu et al. | 335/13 |
| 4,806,893 | 2/1989 | Castonguay et al. | 335/20 |
| 4,939,490 | 7/1990 | Bernier et al. | 335/17 |

*Primary Examiner*—Lincoln Donovan
*Attorney, Agent, or Firm*—Richard A. Menelly

[57] ABSTRACT

A bell alarm unit is attached to the actuator-accessory unit of a molded case circuit breaker. The bell alarm unit consists of a microswitch, printed wire board connector and external wire conductors integrally encapsulated within a plastic composition to provide strain relief to the electrical connections between the printed wire board and the external wire conductors.

4 Claims, 4 Drawing Sheets

MOLDED CASE CIRCUIT BREAKER MODULAR BELL ALARM UNIT

BACKGROUND OF THE INVENTION

The trend in the circuit protection industry is currently toward complete circuit protection which is accomplished by the addition of supplemental protection apparatus to standard overcurrent protective devices, such as molded case circuit breakers. In the past, when such auxiliary protection apparatus or other circuit breaker accessories were combined with a standard circuit breaker, the accessories were usually custom-installed at the point of manufacture. The combined protective device, when later installed in the field, could not be externally accessed for inspection, replacement or repair without destroying the integrity of the circuit breaker interior. An example of one such factory installed circuit breaker accessory is found in U.S. Pat. No. 4,297,663 entitled "Circuit Breaker Accessories Packaged in a Standardized Molded Case".

A more recent example of a circuit breaker including additional accessories is found in U.S. Pat. No. 4,622,444 entitled "Circuit Breaker Housing and Attachment Box" which allows the accessories to be field-installed within the circuit breaker without interfering with the integrity of the circuit breaker internal components. This is accomplished by mounting the accessories within a recess formed in the circuit breaker enclosure cover.

An electronic trip actuator which is mounted within the circuit breaker enclosure is described within U.S. Pat. No. 4,679,019 entitled "Trip Actuator for Molded Case Circuit Breakers". The circuit breaker actuator responds to trip signals generated by an electronic trip unit completely contained within a semi-conductor chip such as that described within U.S. Pat. No. 4,589,052. The development of a combined trip actuator for both overcurrent protection as well as accessory function is found within U.S. Pat. No. 4,700,161 entitled "Combined Trip Unit and Accessory Module for Electronic Trip Circuit Breakers".

A shunt trip accessory unit allows the circuit breaker operating mechanism to be articulated to separate the circuit breaker contacts, usually to perform a tripping function for electrical system control and protection. One such shunt trip accessory unit is described within U.S. Pat. No. 4,786,885 entitled "Molded Case Circuit Breaker Shunt Trip Unit". An auxiliary switch accessory unit allows an operator to determine the "ON" or "OFF" conditions of a molded case circuit breaker contacts at a remote location by means of an audible alarm or visible display. One such auxiliary switch unit is described within U.S. Pat. No. 4,794,356 entitled "Molded Case Circuit Breaker Auxiliary Switch Unit". A more recent example of a combined overcurrent trip actuator and multiple accessory unit is described within U.S. Pat. No. 4,788,621 entitled "Molded Case Circuit Breaker Multiple Accessory Unit" which combined overcurrent trip actuator and multiple accessory unit requires a separate mounting recess within the circuit breaker cover to house the printed wire board that carries the accessory control circuit.

U.S. Pat. No. 4,806,893 describes a molded case circuit breaker actuator-accessory unit wherein the integrated overcurrent trip actuator and multiple accessory unit containing the control electronics and mechanical interface components are contained on a single structure mounted within a single recess.

For purposes of this disclosure, an "electronic circuit breaker" shall mean a molded case circuit breaker that contains an electronic trip unit within a common enclosure with the operating mechanism and the interruptible contacts. A bell alarm unit is a useful accessory when such an electronic circuit interrupter is used within an industrial environment and it is important to know when a piece of manufacturing equipment has been shut down due to interruption of the electric power either by manual or automatic intervention. A space problem is involved in providing an electronic circuit interrupter with a bell alarm unit when the electronic circuit interrupter already contains more than one accessory device. Often times a user would have to select between accessories in view of the limited available space.

U.S. Pat. No. 4,939,490 entitled "Molded Case Circuit Breaker Bell Alarm Unit" describes a compact bell alarm unit that is attached to the side of the combined trip unit and accessory module described within U.S. Pat. No. 4,700,161. The bell alarm unit is attached to a remote bell alarm by means of three wire conductors that could extend a considerable distance from the site of the circuit breaker. This long length of wire conductor exhibits a high degree of strain on the connections between the ends of the wire conductors and the pin connectors on the microswitch used within the bell alarm unit. Encapsulating the connections and the microswitch provides limited strain relief to the connections. Upon long periods of continuous usage, the wire conductors could become loosened within the plastic material and exert increased strain on the electrical connections. All the aforementioned U.S. Patents which represent the advanced state of the art of circuit protection devices are incorporated herein for reference purposes.

One purpose of this invention is to provide a modular bell alarm unit that is attachable to a trip unit and accessory module that will not generate strain on the electrical connections between the wire conductors and the microswitch pin connectors.

SUMMARY OF THE INVENTION

A modular bell alarm unit which includes a microswitch and external wire conductors connected to the microswitch is afforded strain relief to the electrical connections between the microswitch and the electrical conductors by means of an intervening printed wire board. The printed wire board, microswitch and the wire conductor ends are then encapsulated to form an integrated unit enclosure.

DESCRIPTION OF THE PREFERRED EMBODIMENT

Figure 1:
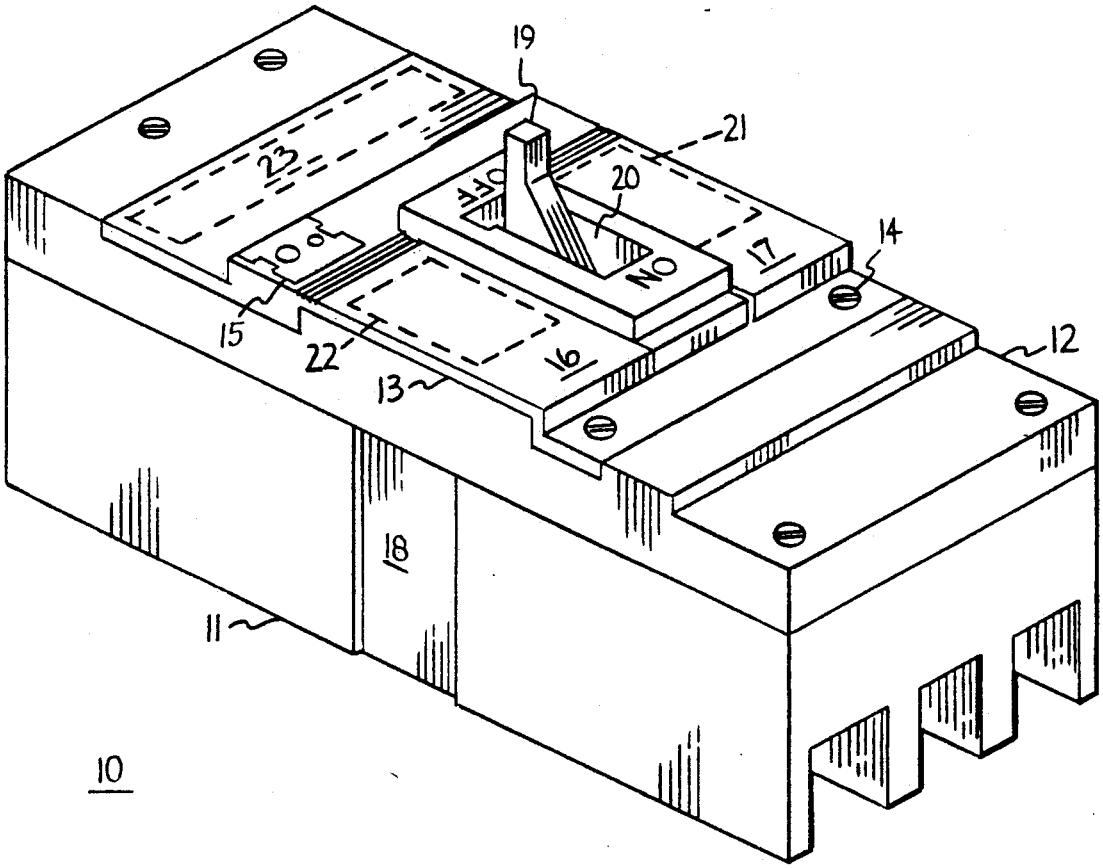
FIG. 1 is a top perspective view of an electronic circuit interrupter including the modular bell alarm unit in accordance with the invention.

An electronic circuit breaker 10 having a molded plastic cover 12 attached to a molded plastic case 11 is shown in FIG. 1 with the accessory cover 13 attached to the circuit breaker cover by means of screws 14. The case includes a wiring slot 18 formed therein for allowing external connection with a remote switch or alarm. The circuit breaker operating handle 19 extends up from an access slot 20 formed in the cover. A rating plug 15 such as described in U.S. Pat. No. 4,728,914 entitled "Rating Plug Enclosure for Molded Case Circuit Breakers", which Patent is incorporated herein for reference purposes, is shown assembled within the accessory cover and connects with the trip unit 23. A pair of accessory doors 16, 17 are formed in the accessory cover for providing access to the combined electromagnetic actuator and multiple accessory unit 21, hereafter "actuator-accessory unit" and the auxiliary switch 22 shown behind the accessory doors. The rating plug 15 is fitted within a recess 26 formed in the accessory cover 13 and the accessory cover is fastened to the circuit breaker cover 12 by means of screws 14, thru-holes 8 and threaded openings 9 as shown in FIG. 2.

Figure 2:
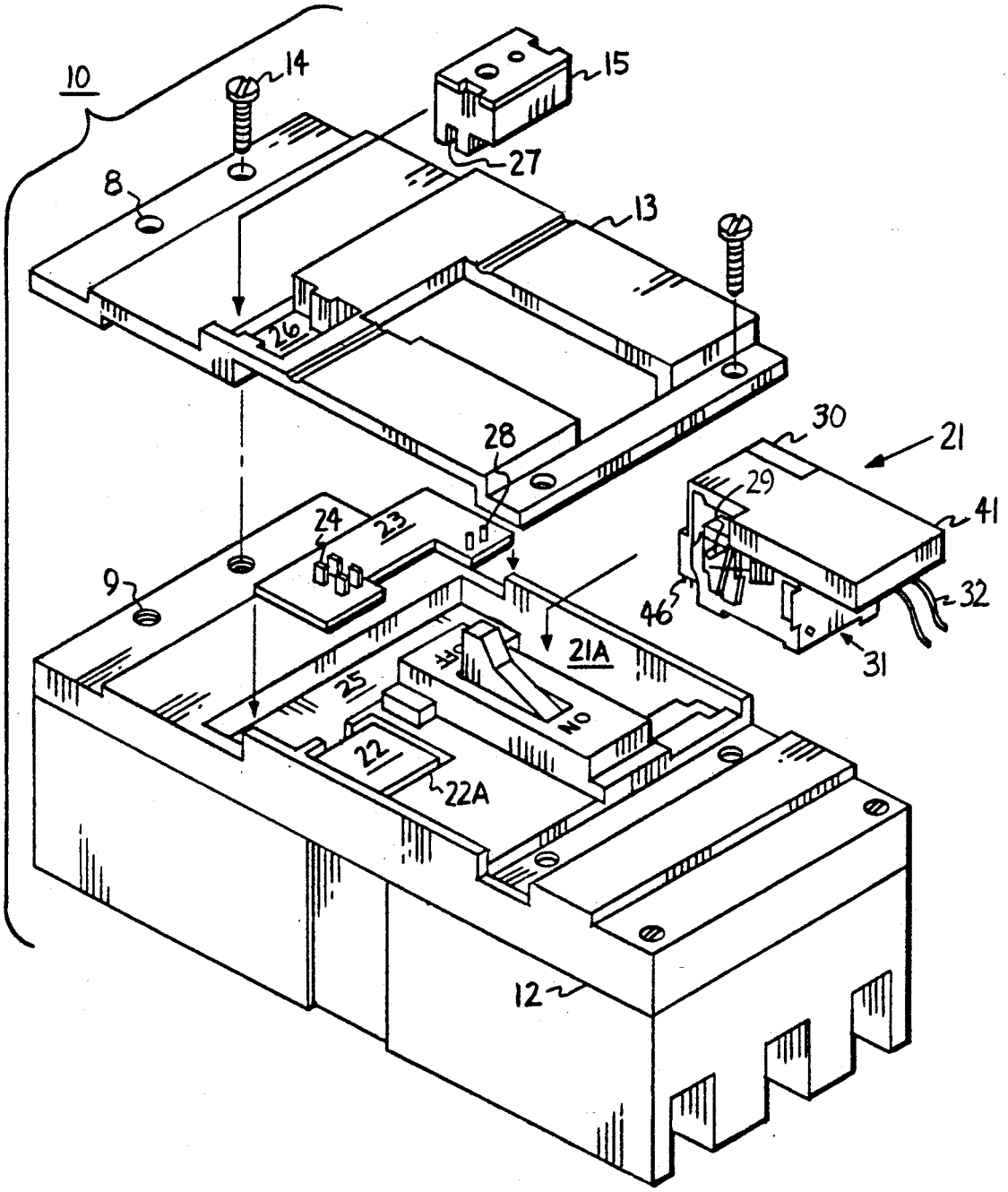
FIG. 2 is a top perspective view of the circuit interrupter of FIG. 1 with the rating plug, trip unit, actuator-accessory unit and accessory cover depicted in isometric projection from the circuit interrupter cover.
Figure 3:
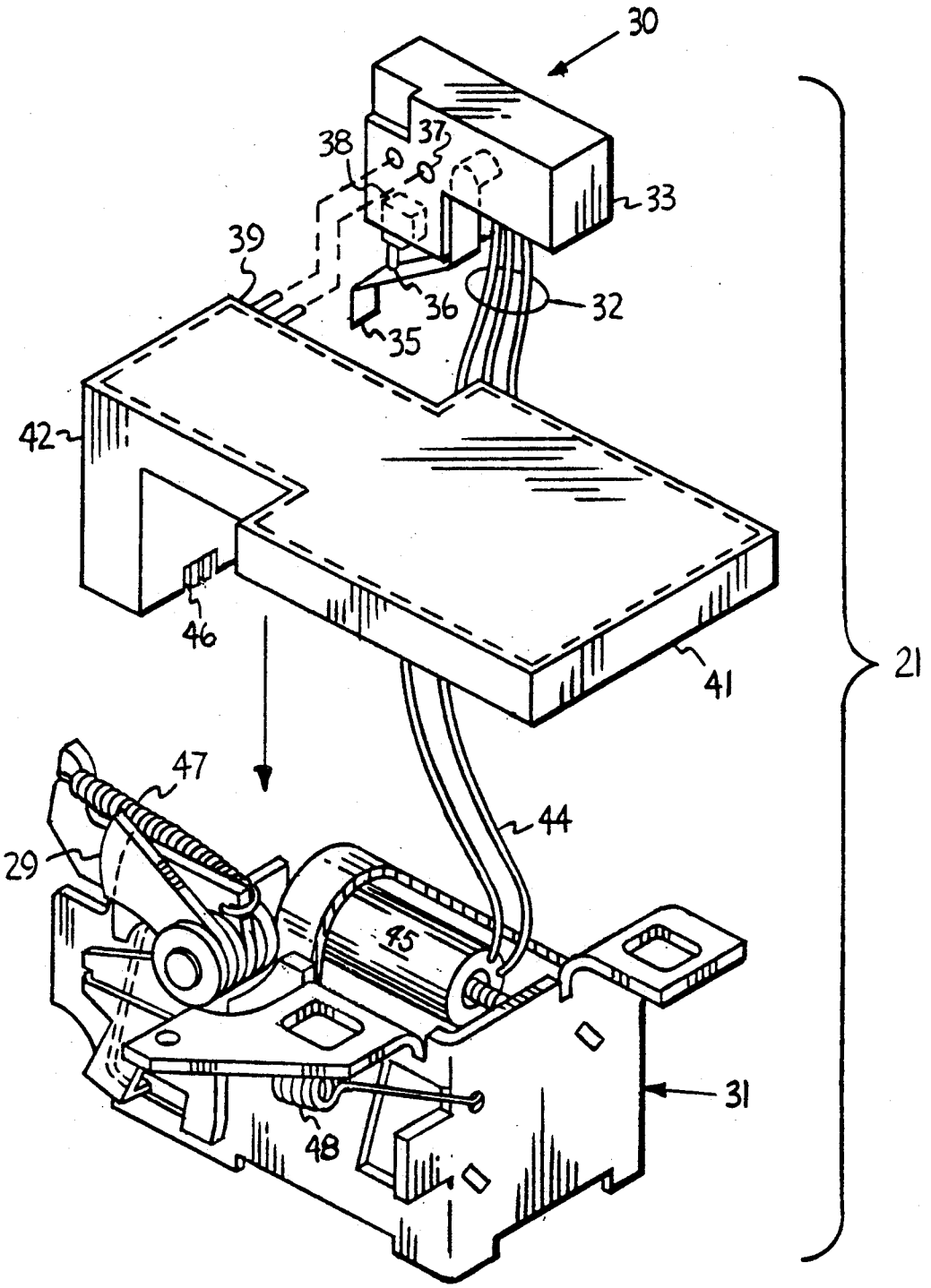
FIG. 3 is a top perspective view of the actuator-accessory unit of FIG. 2 with the modular bell alarm unit in isometric projection.

Still referring to FIG. 2, the trip unit 23 for the circuit breaker is depicted prior to insertion in the trip unit recess 25. The rating plug 15 when inserted within the rating plug recess 26 interconnects with the trip unit by means of pins 24 upstanding from the trip unit and sockets 27 formed on the bottom of the rating plug. The pins 28 upstanding from the trip unit connect with the actuator-accessory unit 21 by means of sockets 46 formed on the bottom of the actuator-accessory unit. External electrical connection with the actuator-accessory unit is made by means of conductors 32. The auxiliary switch 22 is positioned within the auxiliary switch recess 22A and is similar to that described in aforementioned U.S. Pat. No. 4,794,356. When the auxiliary switch and trip unit have been assembled within their appropriate recesses, the actuator-accessory unit 21 which includes a latch 29 on the actuator 31 and the bell alarm unit 30 is then installed within the actuator-accessory unit recess 21A. As shown in FIG. 3, the actuator-accessory unit 21 consists of the actuator 31 which controls the trip actuator latch 29 as described within aforementioned U.S. Pat. No. 4,806,893, and the actuator-accessory coil 45. The actuator-accessory plastic top enclosure 41 containing the actuator-accessory electronics is attached to the top of the actuator 31. The reset spring 47 and the latch spring 48 control the operation of the actuator latch 29. The actuator-accessory coil 45 connects with the actuator-accessory electronics contained within the plastic top enclosure 41 over conductors 44. The electronics within the plastic top enclosure 41 connects with the trip unit by means of the sockets 46 formed on the bottom of the front extension 42, as described earlier. The bell alarm unit 30 is attached to the actuator-accessory unit by capturing a pair of posts 39 integrally-formed with the plastic top enclosure 41 within a pair of thru-holes 37 formed through the plastic bell alarm housing 33. The bell alarm unit 30 includes a microswitch 38 which is encapsulated within the plastic housing 33 such that the switch button 36 extends external from the housing. An S-shaped return spring 35 is positioned under the switch button and is supported on the bell alarm unit by encapsulating within the plastic bell alarm housing 33. Electrical connection with the bell alarm is made by wire conductors 32 which are also encapsulated within the plastic bell alarm housing. When the bell alarm is supported upon the posts 39, any external strain applied to the wire conductors is transmitted through the bell alarm plastic housing against the interior surface of the circuit breaker cover 12 shown earlier in FIG. 2.

Figure 4:
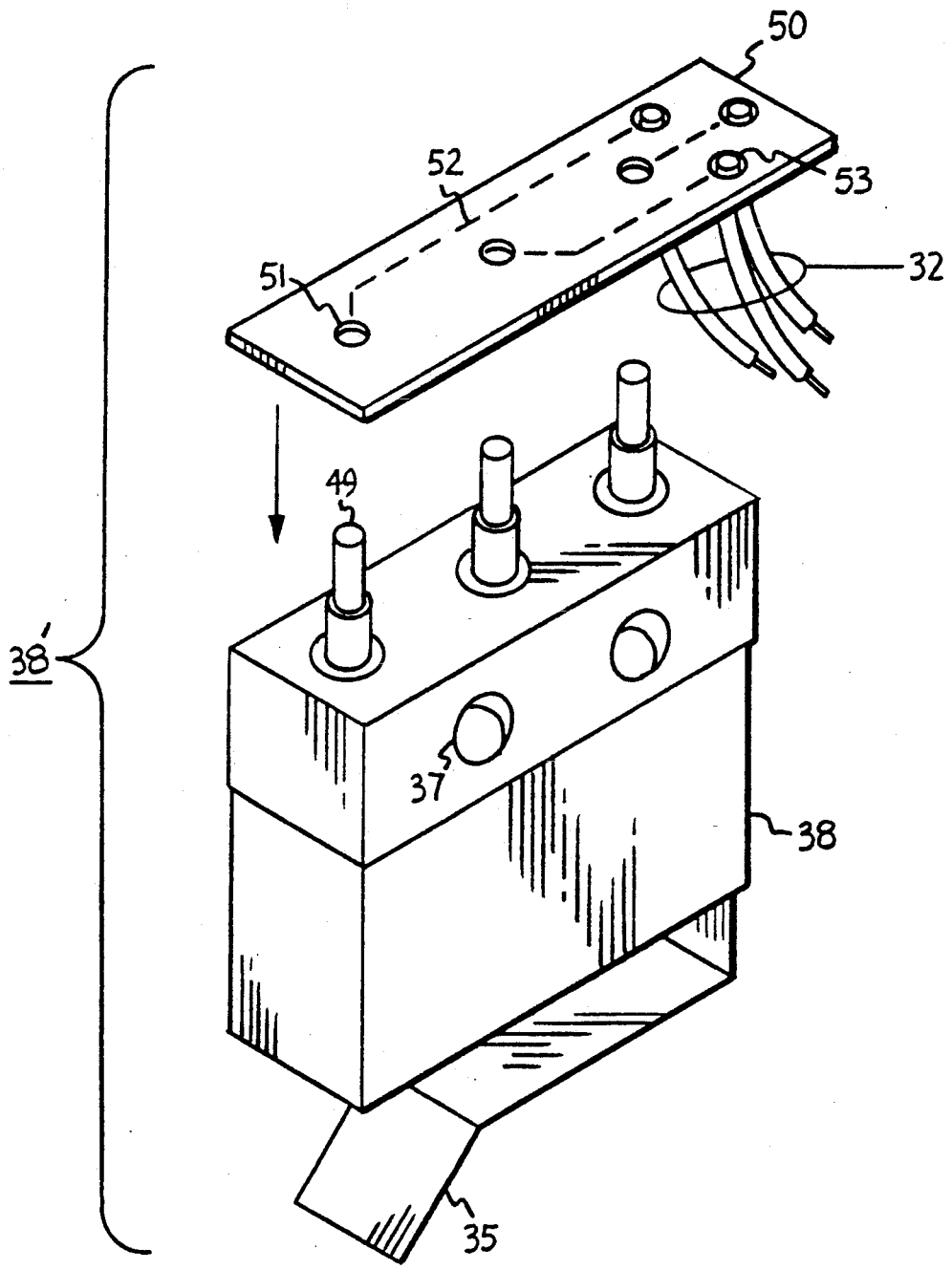
FIG. 4 is an enlarged top perspective view of the modular bell alarm unit of FIG. 3 prior to assembly and encapsulation.

In accordance with the invention, a microswitch subassembly 38' is shown in FIG. 4 wherein the wire conductors 32 that provide electrical connection to the bell alarm unit of FIG. 3 is provided with additional strain relief by the imposition of a printed wire board 50 of an insulative fibre glass composition and which includes apertures 51 for capturing the pin connectors 49 upstanding from the top surface of the microswitch 38 opposite the return spring 35. The exposed ends of the wire conductors 32 are soldered or welded to the printed wire board as depicted at 53 and electrically connect with the pin connectors 49 by means of the conductive pods 52 integrally-formed on the printed wire board. When the pin connectors are inserted within the apertures, they are also welded or soldered to provide good electrical connection with the wire pod conductors. The microswitch subassembly 38' is encapsulated in plastic material to form the modular bell alarm unit 33 shown earlier which is later attached to the actuator-accessory unit by means of thru-holes 37. When the subassembly is encapsulated with a part of the wire conductors within the plastic material to form the complete bell alarm unit, additional mechanical and electrical connection is provided between the wire conductors and the printed wire board as well as between the printed wire board and the microswitch which substantially increases the strain relief to the wire conductors.

Having thus described our invention, what we claim as new and desire to secure by Letters Patent is:

1. A modular bell alarm switch comprising:

a microswitch having an external plunger extending from one surface operating a pair of internal contacts;

a pair of pin connectors extending from an opposite surface connecting with said contacts;

a printed wire board having electrically connected first and second apertures, said pin connectors being within said first apertures; and electrical wire conductors electrically connected with said second apertures to thereby provide electrical connection between said wire conductors and said pin connectors, said wire conductors providing means for electrical connection with said microswitch from a remote location, said microswitch, said printed wire board and a part of said wire conductors being encapsulated in a plastic composition to form a modular assembly.

2. The bell alarm switch of claim 1 including a spring arranged on said one surface proximate said plunger contacting said plunger to connect said contacts and releasing said plunger to disconnect said contacts.

3. The bell alarm switch of claim 1 including apertures through said plastic composition for mounting said microswitch to a support.

4. A molded case circuit breaker having remote indication function comprising:

a plastic case and cover;

a pair of contacts within said case arranged for automatic separation upon occurrence of an overcurrent condition through said contacts;

a bell alarm switch within said cover arranged for providing remote indication of ON-OFF conditions of said contacts, said bell alarm switch comprising a microswitch having a printed wire board on one surface, said printed wire board providing electrical connection between pin connectors extending from said microswitch and wire conductors extending from said printed wire board to outside said circuit breaker cover, said microswitch, printed wire board and part of said wire conductors being encapsulated in a plastic composition forming a modular assembly; and an electromagnetic actuator in said case, said bell alarm switch being attached to said actuator, said actuator including pins extending through complementary holes formed in said plastic composition.

* * * * *